United States Patent [19]

Yoshida

[11] Patent Number: 4,815,176

[45] Date of Patent: Mar. 28, 1989

[54] LOCK DEVICE FOR SLIDE FASTENER SLIDERS

[75] Inventor: Hiroshi Yoshida, Kurobe, Japan

[73] Assignee: Yoshida Kogyo K. K., Tokyo, Japan

[21] Appl. No.: 151,490

[22] Filed: Feb. 2, 1988

[30] Foreign Application Priority Data

Feb. 3, 1987 [JP] Japan ..... 62-23281

[51] Int. Cl.[4] ..... A44B 19/26

[52] U.S. Cl. ..... 24/387; 24/419; 24/429

[58] Field of Search ..... 24/387, 419, 420, 429; 70/38 A; 292/307 R

[56] References Cited

U.S. PATENT DOCUMENTS

| | | | |
|---|---|---|---|
| 2,942,450 | 6/1960 | Krug | 24/387 |
| 3,979,931 | 9/1976 | Man | 70/38 A |
| 4,130,918 | 12/1978 | Ishii et al. | 24/419 |
| 4,624,032 | 11/1986 | Ishii et al. | 24/419 |

FOREIGN PATENT DOCUMENTS

| | | | |
|---|---|---|---|
| 1435840 | 1/1969 | Fed. Rep. of Germany | 24/387 |
| 2605206 | 8/1976 | Fed. Rep. of Germany | 24/387 |
| 1005546 | 4/1952 | France | 24/387 |
| 33-14493 | 9/1958 | Japan . | |
| 57-23647 | 5/1982 | Japan . | |
| 2079362 | 1/1982 | United Kingdom | 24/387 |

*Primary Examiner*—Victor N. Sakran

[57] ABSTRACT

A lock device for a container having an opening adapted to be opened and closed by a slide fastener is composed of only three structural components, namely a slide fastener slider having a closure member slidably mounted thereon for opening and closing a gap between an arch-shaped lug and the slider body, a lock ring adapted to be connected to the container and capable of being threaded through the gap onto the lug to lock the slider in position against movement, and a separate unlock pin manually operative to move the closure member to its open position for releasing the slider from the lock ring.

10 Claims, 9 Drawing Sheets

LOCK DEVICE FOR SLIDE FASTENER SLIDERS

BACKGROUND OF THE INVENTION

1. Field of the Invention

This invention relates to a lock device for releasably holding a slider in the fastener full-closing position of a slide fastener attached to a container such as bag, luggage or trunk for closing an opening in the container.

2. Prior Art

A typical example of the known slider lock devices of the type described is disclosed in Japanese Utility Model Publication No. 33-14493. The disclosed lock device includes a box-like housing attachted to a container and having a cylinder lock mechanism for releasably holding the pull tab of a slider in position against movement. Another known lock device shown in Japanese Utility Model Publication No. 57-23647 includes a male lock member pivotally connected to the pull tab of a slider and snappingly engageable with a female lock member to lock the slider in position against displacement.

The lock device shown in the first-mentioned Japanese publication has a drawback that since the housing projects into the container, the interior space of the container is reduced in the vicinity of the housing and an article in the container may be damaged when engaged with the housing. The lock device of the latter-mentioned Japanese publication is also disadvantageous in that the male lock member when unlocked is unsightly dangling from the slider pull tab and produces unpleasant shock noises. Furthermore, both of the known slider lock devices are defective from the aesthetic view because their lock mechanisms can be observed from the outside of the container.

SUMMARY OF THE INVENTION

With the foregoing difficulties in view, it is an object of the present invention to provide a slider lock device which is sightly in appearance, is compact in size and is simple in construction and reliable in operation.

In summary, a lock device of the present invention is composed of only three structural components, namely a slide fastener slider constructed to accommodate a detachable pull tab, a lock ring adapted to be connected to a container to which a slide fastnener is attached for closing an opening in the container, and a manually operative pin.

According to the present invention, there is provided a lock device for a slider which comprises: a slider body including an arch-shaped lug extending over the top surface of an upper wing and having one end connected to the front end of the upper wing and an opposite end directed toward the top surface and spaced therefrom by a gap, and a closure member slidably mounted in the upper wing and movable between a closed position to substantially close the gap and an open position to open the gap, the closure member being normally urged to the closed position; a lock ring adapted to be connected to a portion of the container adjacent to the fastener full-closing position, the lock ring being receivable through the gap into a space defined between the upper wing and the arch-shaped lug for locking the slider body in the fastener full-closing position; and a manually operative pin engageable with the closure member to urge the same to its open position to thereby allow the lock ring to be threaded through the gap into and out of the space.

When the slider is to be locked in the fastener full-closing position, the closure member is moved from its closed position to its open position by simply pushing the closure member by the lock ring until the gap between the opposite end of the arch-shaped lug and the upper wing of the slider body is opened. The lock ring has now threaded through the gap into the space between the lug and the upper wing, whereupon the closure member returns to its closed position to thereby lock the slider in position against movement in a slider opening direction.

To unlock the slider, the closure member is moved toward the open position by means of the manually operative pin until the gap is opened. The lock ring is thus allowed to be threaded through the gap out of the lug.

Since the closure member is small and fully received in the slider body, and since the locking ring is simple in construction, the lock device of the invention is sightly in appearance. The lock device is fully disposed outside the container and hence articles in the container are free from damage. The closure member is stably retained in the slider body and does not produce unpleasant shock noise when the slide is in unlocked condition.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
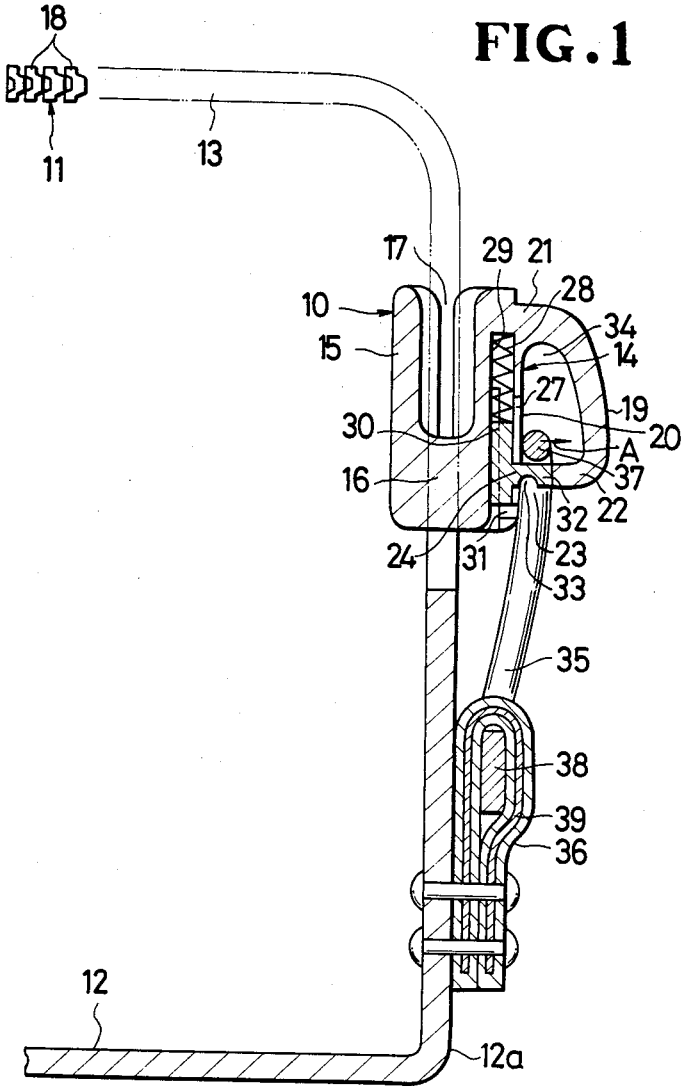
FIG. 1 is a longitudinal cross-sectional view of a lock device according to the present invention.
Figure 3:
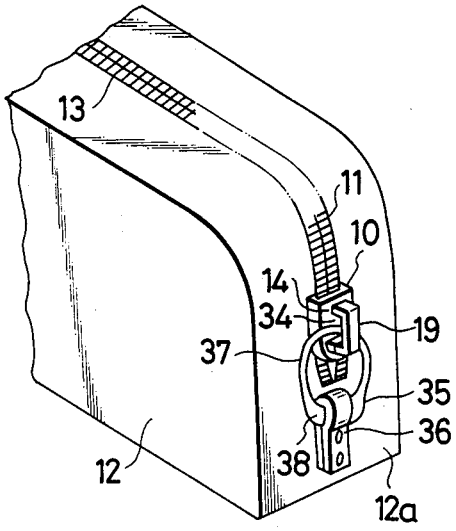
FIG. 3 is a fragmentary perspective view, on reduced scale, of FIG. 1.

FIGS. 1 and 3 show a first embodiment of slider lock device according to the present invention. The lock device is associated with a slider 10 of a slide fastener 11 attached to a container or bag 12 for closing an opening 13 in the bag 12.

The slider 10, as shown in FIG. 1, includes a slider body having upper and lower wings 14, 15 joined at their front ends by a neck 16 so as to define therebetween a guide channel 17 for the passage therethrough of a pair of rows of coupling elements 18 of the slide fastener 11. The slider body has an arch-shaped lug 19 extending longitudinally over the top surface 20 of the upper wing 14. The arch-shaped lug 19 has one end 21 integrally connected with the front end of the upper wing 14, an opposite end 22 of the lug 19 being directed downwardly toward and spaced from the top surface 20 by a predetermined gap 23.

Figure 2:
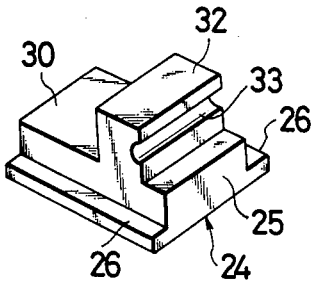
FIG. 2 is an enlarged perspective view of a closure member of the lock device shown in FIG. 1.

The slider body further has a closure member 24 slidably mounted thereon and movable between a closed position to substantially close the gap 23 and an open position to open the gap 23. The closure member 24, as shown in FIG. 2, has a generally rectangular body 25 having a pair of side rails 26. The closure member 24 is slidably received in a longitudinal guide groove 27 extending in the top surface 20 of the upper wing 14 from its rear end and terminating short of the fixed front end 21 of the lug 19, as shown in FIG. 1. The guide groove 27 has an inverted T-shape in cross section which is complementary in contour to the closure member 24. A compression coil spring 28 is disposed in an end extension 29 of the guide groove 27 and acts between the slider body and a front end 30 of the closure member 24 to urge the closure member 24 into abutment with stoppers 31 (only one shown in FIG. 1) disposed on the rear end of the upper wing 14. In this instance, the closure projection 32 on the closure member 24 is disposed in confrontation with the end 22 of the arch-shaped lug 19 to substantially close the gap 23. Thus, the closure member 24 is normally urged to the closed position by the compression spring 28.

The closure projection 32 has a transverse recess 33 facing opposite to a space 34 defined between the arch-shaped lug 19 and the top surface 20 of the upper wing 14. The space 34 is normally closed by the closure projection 32 and is communicatable with the outside of the lug 19 through the gap 23 when the closure member 24 is moved forwardly against the bias of the compression coil spring 28.

The lock device also includes a lock ring 35 connected by a retainer strap 36 to one side 21*a* of the bag 12 at a position adjacent to a fastener full-closing position on the slide fastener 11 in which the slider 10 is disposed when the slide fastener 11 is fully closed.

The lock ring 35 includes a first circumferential portion 37 having a thickness which is smaller than the gap 23 so that the lock ring 35 can be threaded through the gap 23 onto the lug 19. The base portion 38 of the lock ring 35 which is diametrically opposite to the first portion 37 is flattened and stably supported by a loop of the retainer strap 36 with a reinforcing metal strip 39 disposed between the flattened portion 38 and the retainer strap 36. The retainer strap 36 and the reinforcing strip 39 are rivetted to the side 12*a* of the bag 12. With the provision of the reinforcing metal strip 39, the lock ring 35 is stably held in position against wobbling.

The lock device of the foregoing construction operates as follows. When the slider 10 is to be locked, the slider 10 is moved toward the fastener full-closing position until the closure projection 32 on the closure member 24 is brought into contact with the portion 37 of the lock ring 35. A further advancing movement of the slider 10 causes the closure member 24 to be moved by the locking ring 34 toward its open position whereupon the ring portion 37 is inserted through the gap 23 into the space 34 between the lug 19 and the upper wing 14 of the slider body. Then the ring portion 37 is displaced toward the lug 19 as indicated by the arrow A of FIG. 1, whereupon the closure member 24 is returned to its closed position under the force of the compression coil spring 28. The slider 10 is thus locked in position against displacement.

To unlock the slider 10, an unlock pin 40 (FIG. 40) is gripped by the user's fingers and, while keeping a tip end 41 of the pin 40 in register with the recess 33 in the closure projection 32, the pin 40 is pushed to displace the closure member 24 toward its open position until the gap 23 is opened. The ring portion 37 of the lock ring 35 is now allowed to be removed from the space 34 through the gap 23, thereby unlocking the slider 10. The unlock pin 40 has an annular head 42 through which a ring of a key-holder (not shown) extends to carry the unlock pin 40.

The slider 10 of the afore-mentioned embodiment is not equipped with a pull tab. It is possible to provide the slider body with a pull tab when the space 34 is large enough to concurrently accommodate a pintle of the pull tab and the ring portion 37 of the lock ring 35. The pull tab may be omitted when the slide fastener is opened and closed infrequently or the pull tab is likely to hinder smooth locking and unlocking operation of the lock device.

Figure 5:
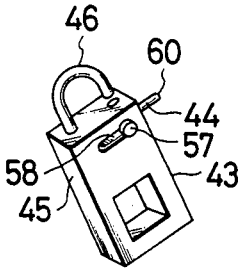
FIG. 5 is a perspective view of a pull tab useable with the lock device.
Figure 6:
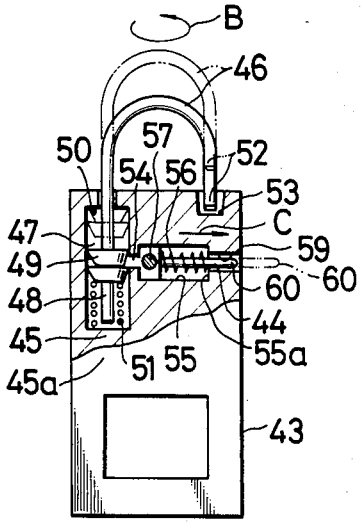
FIG. 6 is an enlarged plan view, partly in cross section, of the pull tab shown in FIG. 5.

FIGS. 5 and 6 show an example of pull tab which is detachably connected to the lug 19 of the slider 10 shown in FIG. 1. The pull tab 43 includes an unlock pin 44 slidably mounted therein and movable to project from and retracted into the pull tab 43.

The pull tab 43 includes a rectangular body 45 and a hook-shaped link or shackle 46 pivotally supported on the body 45. The pull tab body 45 has a longitudinal hole 47 extending along one side edge of the body 45 and slidably receiving therein a base portion 48 of the shackle 46. The base portion 48 has a plurality of barb-like members 49 engageable with an upper shoulder 50 of the hole 47 to prevent the shackle 46 from being detached from the pull tab body 45. A compression coil spring 51 is disposed in the hole 47 and acts between the pull tab body 45 and a lowermost one of the barb-like members 49 to urge the shackle 46 upwardly until the uppermost barb-like member 49 engages the shoulder 50. In this instance, the shackle 46 projects from outwardly from the body 45 in a position indicated by the phantom lines in FIG. 6 in which the free end 52 is disposed outside a longitudinal recess 53 in the body 45. In the phantom lined position, the shackle 46 is rotatable about the base postion 48 as indicated by the arrow B in the same figure. The rotating movement of the shackle 46 is prevented when the shackle 46 is depressed until its free end 52 is received in the recess 53 as indicated by the solid lines. The shackle 46 is locked in this solid-lined position by a latch bolt 54 held in mesh with the barb-like members 49 on the base portion 48.

The latch bolt 54 is slidably received in a transverse hole 55 extending in the body 45 perpendicular to the longitudinal hole 47. The latch bolt 54 is normally urged into interlocking engagement with the barb-like members by means of a compression coil spring 56 disposed in the transverse hole 55 and acting between the rear end of the latch bolt 54 and a right shoulder 55*a* of the hole 55.

In order to disengage the latch bolt 54 from the barb-like members 49, there is provided an actuating pin 57 connected with the latch bolt 54 and extending therefrom through a transverse window 58 (FIG. 5) to the outside of the pull tab body 45, the window 58 being formed in the top surface 45*a* of the body 45. In use, the actuating pin 57 is moved in the direction of the arrow C along the window 58 to disengate the latch bolt 54 from the barb-like members 49, whereupon the shackle 46 is projected outwardly under the force of the compression coil spring 51.

Figure 4:
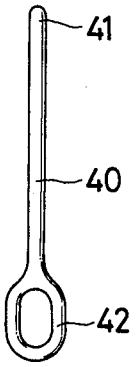
FIG. 4 is a front elevational view of an unlock pin of the lock device.

The unlock pin 44 extends from the rear end of the latch bolt 54 and is slidably received in a transverse guide hole 59 extending contiguously from the hole 55. The unlock pin 44 has a length such that the outer end 60 of the pin 44 is fully received in the pull tab body 45 when the latch bolt 54 is held in mesh with the barb-like members 49, while the outer end 60 prejects laterally from the slider body 45 as indicated by the phantom lines when the actuating pin 57 is brought into engagement with one end of the window 58 remote from the base portion 48 of the shackle 46. The unlock pin 44 while being held in the projecting position is used to displace the closure member 24 in the same menner as done by the unlock pin 40 shown in FIG. 4.

Figure 7:
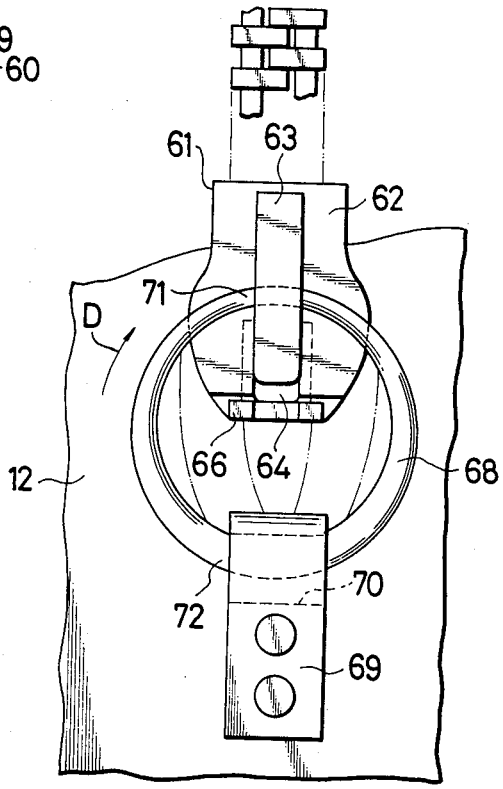
FIG. 7 is a plan view of a modified lock device.
Figure 8:
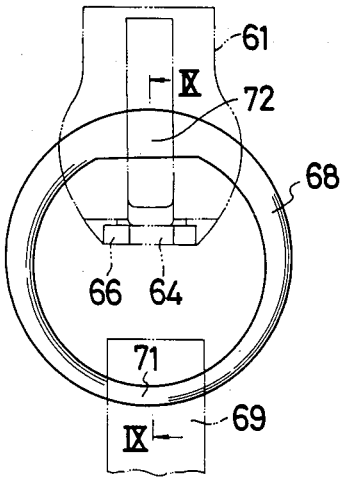
FIG. 8 is a plan view of a lock ring of the modified lock device.
Figure 9:
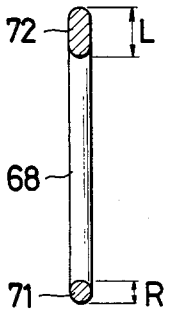
FIG. 9 is a cross-sectional view taken along line IX—IX of FIG. 8.

FIGS. 7 through 11 inclusive show a modified lock device of the present invention. The lock device is comprised by a part of a slider 61 which includes an upper wing 62 and an arch-shaped lug 63 disposed thereon with a space 65 (FIG. 10A) defined therebetween, the space 65 communicating with the outside of the slider 61 through a gap 64. The slider 61 further includes a closure member 66 slidably disposed in the space 65 for opening and closing the gap 64 by a closure projection 67. The lock device further has a locking ring 68 connected by a retainer strap 69 to the bag 12. The locking ring 68 is loosely retained by a loop 70 of the retainer strap 69 so that the ring 68 is rotatable in the direcion indicated by the arrow D in FIG. 7. The lock ring 68 has a first circumferential portion 71 so dimensioned as to pass through the gap 64 and a second circumferential portion 72 so dimensioned as to block the gap 64. As shown in FIG. 9, the first circumferential portion 71 has a circular cross-sectional shape having a diameter R smaller than the gap 64 while the second circumferential portion 72 has an oblong cross-sectional shape having a width L. The first and second circumferential portions 71, 72 are disposed diametrically opposite to one another.

Figure 10A:
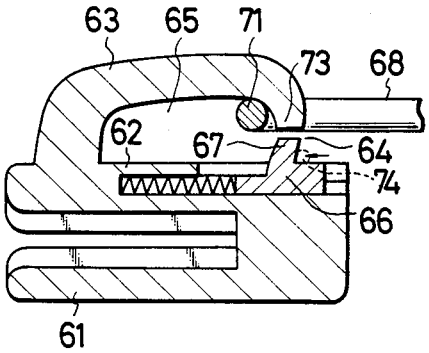
FIG. 10A is a longitudinal cross-sectional view of the lock device with parts shown in locking position.
Figure 10B:
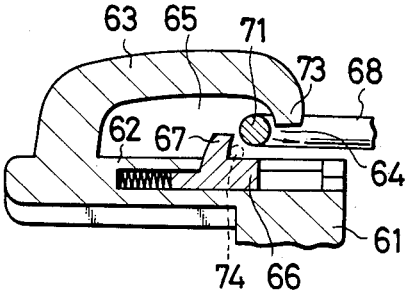
FIG. 10B is a view similar to FIG. 10A, but showing the lock device with parts in unlocking position.

When the closure member 66 is moved from its closed position of FIG. 10A to the open position of FIG. 10B by pushing the closure member 66 by means of an unlock pin 74, the closure projection 67 and the free end 73 of the lug 63 define therebetween the gap 64 which is larger than the diameter R of the first circumferential portion 71, thereby allowing passage of the first portion 71 through the gap 64. The gap 64 is smaller than the width L of the second circumferential portion 72 and hence blocks passage of the second portion 72 therethrough.

Figure 11:
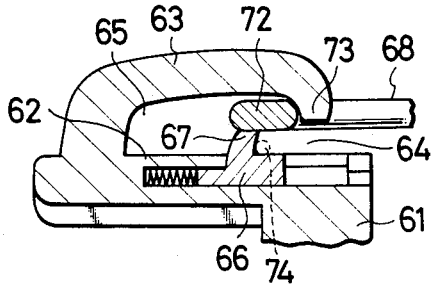
FIG. 11 is a view similar to FIG. 10B, but showing a lock ring held in a position to prevent removal from a slider.

In the course of the locking operation, the locking ring 68 is threaded on the lug 63 of the slider 61 as shown in FIGS. 7 and 10A and then is turned about itself in the direction of the arrow D through an angle of 180 degrees until the second circumferential portion 72 is received in the space 65, as shown in FIG. 8. The slider 61 is firmly held in interlocking engagement with the lock ring 68. This locking engagement can be maintained even when the closure member 66 is displaced to the open position as shown in FIG. 11. To unlock the slider 61, the lock ring 68 is turned about itself through an angle of 180 degrees until the first circumferential portion 71 is received in the space 65.

FIGS. 12–14B show a slider 75 which constitutes part of a lock device of the invention. The slider 75 includes a self-locking mechanism 76 having a vertical lock member 77.

Figure 12:
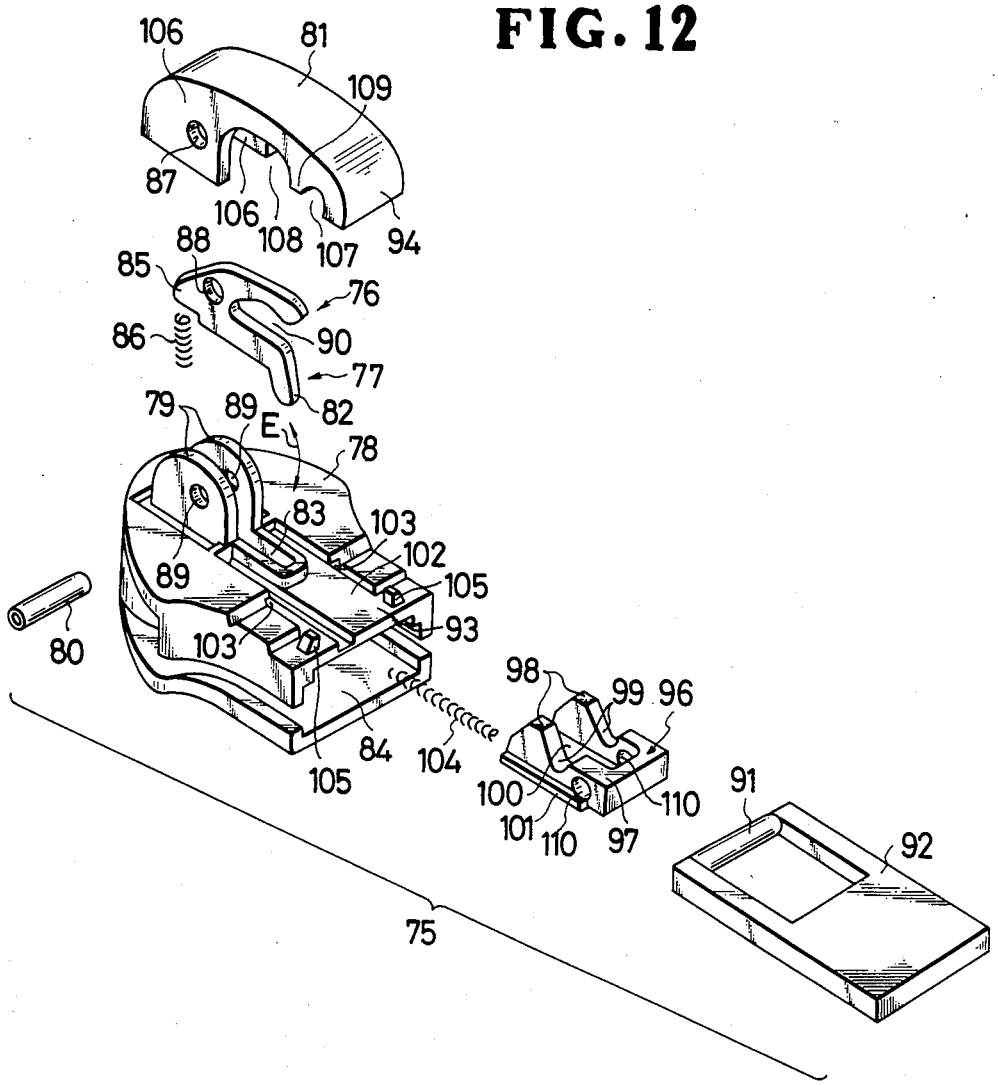
FIG. 12 is an exploded perspective view of a slider constituting part of a modified lock device according to the invention.

As shown in FIG. 12, the slider 75 includes an upper wing 78 carrying thereon a pair of laterally spaced upstanding supports 79 to which an arch-shaped lug 81 is connected by a pin 80. The lock member 77 is pivotally movable about the pin 80 in opposite directions indicated by the arrow E.

The lock member 77 has a downwardly projecting locking prong 82 movable through an aperture 83 in the upper wing 78 into a guide channel 84 for interlocking engagement with coupling element to lock the slider 75 in position against movement. The lock member 77 is normally urged by a compression coil spring 86 to turn clockwise about the pin 80 into its locking position in which the locking prong 82 is disposed in the guide channel 84. The spring 86 acts between the slider body and the front end 85 of the lock member 77. In FIG. 12, the reference numeral 70 denotes a horizontal pin hole formed in the lug 81, 88 a horizontal pin hole in the lock member 77, and 89 a pair of horizontal pin holes in the respective supports 79, the pin 80 being threaded through the pin holes 87–89. The lock member 77 further has a rearwardly opening recess 90 for receiving therein a pintle 91 of a pull tab 92.

The self-locking mechanism 76 is received in a space between the lug 81 and the upper wing 78 as shown in FIGS. 13A through 13E.

The top surface 93 of the upper wing 78 and the free end 94 of the lug 81 define therebetween a gap 95. A closure member 96 is slidably mounted in the upper wing 78 and movable between a closed position to close the gap 95 and an open position to open the gap 95. The closure member 96, as best shown in FIG. 12, has a U-shape and includes a first closure portion 97 in the shape of a flat land extending around the rear end of the closure member 96, and a second closure portion composed of a pair of laterally spaced closure projections 98. The first and second closure portions 97, 98 are spaced from one another by a pair of arcuate recesses 99 in which the pintle 91 of the pull tab 92 is temporarily arrested during attachment and detachment with the slider 75. The U-shaped closure member 96 has a forwardly opening central groove 100 receptive of a peripheral wall of the aperture 83. The closure member 96 further has a pair of lateral guide rails 101 receivable in a pair of lateral guide grooves 103 when the body of the closure member 96 is slidably received in a central guide groove 102 formed in the upper wing 78. The closure member 96 is normally urged by a compression coil spring 104 to the closed position in which the closure member 96 is held in abutment with a pair of stops 105.

The arch-shaped lug 81 is hollow in construction and has a U-shaped transverse cross section. Each of the vertical side walls 106 of the hollow lug 81 has a pair of longitudinally spaced, downwardly facing first and second arcuate recesses 107, 108 separated by a downwardly extending projection 109. The first recesses 107 and the projections 109 are disposed substantially in vertical alignment respectively with the arcuate recesses 99 and the closure projections 98 when the closure member 96 is held in its closed position. The second recess 108 mutually receives therein the pintle 91 of the pull tab 92.

The slider 75 is locked in position by means of a lock ring which is the same in construction as the locking ring 68 shown in FIGS. 7–9. The lock ring 68 includes a first circumferential portion 71 of a circular cross-sectional shape having a diameter substantially equal to the diameter of the pintle 91 of the pull tab 92 so that this portion 71 can be threaded through the gap 95. Conversely, the second circumferential portion 72 of an oblong cross-sectional shape having a width which is larger than the gap 95 and hence blocks the gap 95.

In operation, the slider 75 is moved to an end position for fully closing a slide fastener by manipulating the pull tab 92. Then, the pull tab 92 is detached from the slider body. Finally the slider 75 is locked in position by the lock ring 68. Successive steps of the pull-tab removing operation are illustrated in FIGS. 13A to 13E. It is to be noted that detachment of the lock ring 68 can be achieved in the same manner as the removal of the pull tab 92. Likewise, attachment of the pull tab 92 to the slider 75 and locking of the slider 75 by the lock ring 68 can be effected by merely reversing the order of successive steps of operation.

Figure 13A:
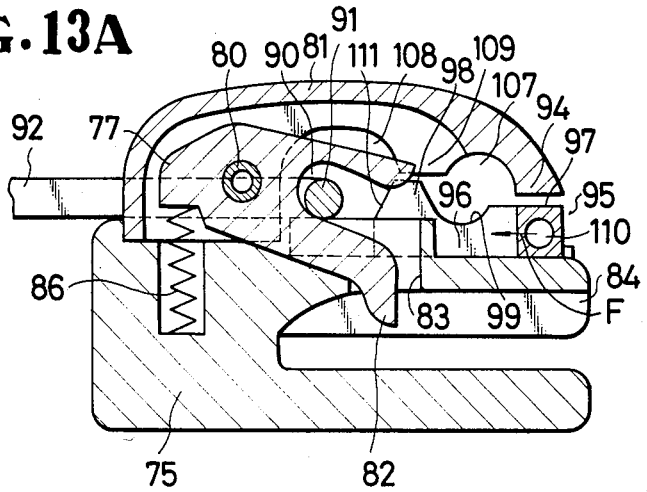
FIGS. 13A through 13E are longitudinal cross-sectional views of the slider, illustrative of the sequence of a pull tab detacking operation.

As shown in FIG. 13A, the pull tab 92 extends flatwise over the upper wing of the slider 75 and the locking prong 82 of the lock member 77 is urged by the spring 87 to project through the aperture 83 into the guide channel 84 for interlocking engagement with the coupling elements (not shown), thereby locking the slider 75 on the coupling element rows. The pintle 91 of the pull tab 92 is received in the recess 90 in the lock member 77 within the space between the lug 81 and the upper wing of the slider 75.

Figure 13B:
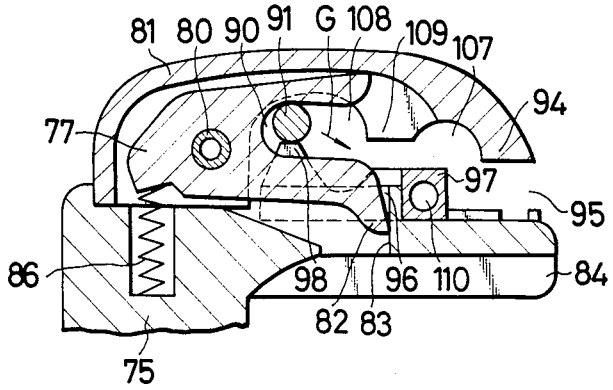

To detach the pull tab 92 from the slider 95 and then lock the slider 75 with the lock ring 68, the closure member 96 is moved forwardly in the direction indicated by the arrow F in FIG. 13A by pushing the closure meber 96 by a pin 40 (see FIG. 4) inserted in a pair of laterally aligned guide holes 110 formed in the first closure portion 97. With this advancing movement of the closure member 96, the pintle 91 slides upwardly along an oblique front faces 111 of the respective closure projections 98 to thereby turn the lock member 77 counterclockwise about the pin 80, as shown in FIG. 13B. The locking prong 82 is thus disengaged from the coupling elements of the slide fastener. The upward pivotal movement of the lock member 77 is also realized by simply pulling the pull tab 92 upwardly.

A further advancing movement of the closure member 96 causes the pintle 91 to be moved past the closure porjections 98 on the closure member 96 and then slide down in the direction indicated by the arrow G in FIG. 13B. Thus the pintle 91 is received in the arcuate recesses 99 (FIG. 13A) in the closure member 96.

Figure 13C:
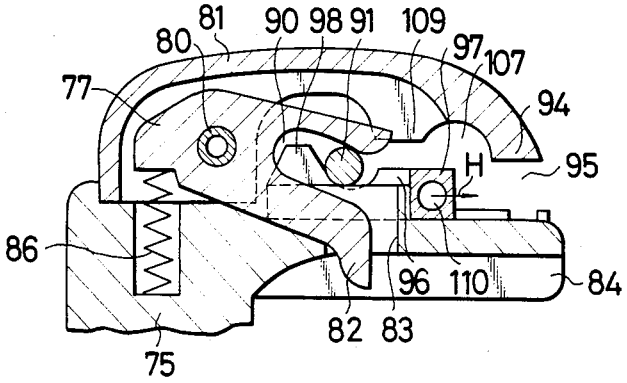

Then the closure member 96 is released from pressure of the unlock pin 40, whereupon the closure member 96 is moved backwardly in the direction of the arrow H in FIG. 13C under the force of the compression coil spring 104 (FIG. 12). When the closure member 96 reaches to its closed position, the pintle 91 is disposed between the recesses 107 in the lug 81 and the corresponding recesses 99 in the closure member 96, as shown in FIG. 13D.

Figure 13D:
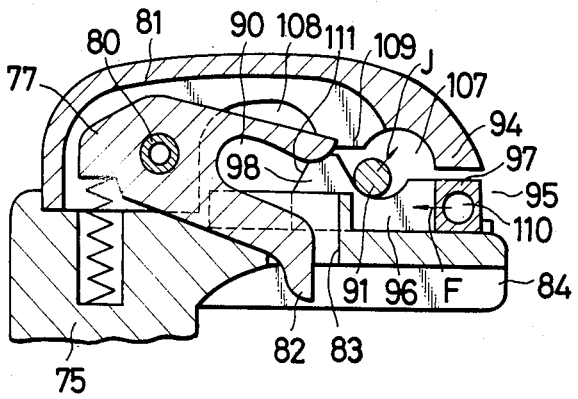
Figure 13E:
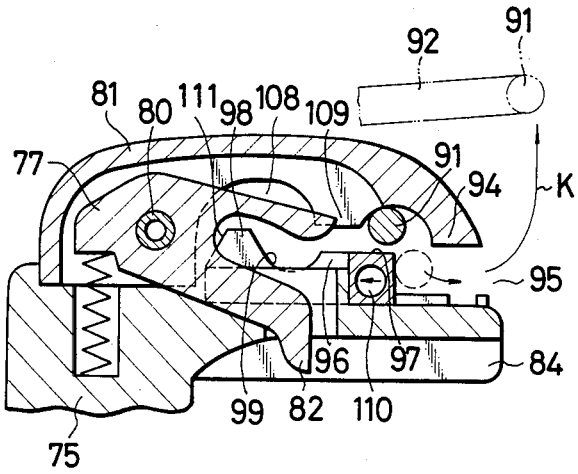

Thereafter, the pull tab 92 is pulled upwardly until the pintle 91 is substantially fully retracted in the recesses 107 in the lug 81, as indicated by the arrow J in FIG. 13D. While keeping this condition, the closure member 96 is moved again in the direction of the arrow F. Consequently, the gap 95 is opened as shown in FIG. 13E. Now, the pintle 91 is removed from the slider body through the thus opened gap 95 as indicated by the arrow K in the same figure.

The foregoing detachment of the pull tab 92 is followed by the locking of the slider 75. The slider locking operation is achieved by inserting the circumferential portion 71 of the lock ring 68 into the recess 90 in the lock member 77 by taking the reverse course of the foregoing pull tab detachment operation.

Figure 14A:
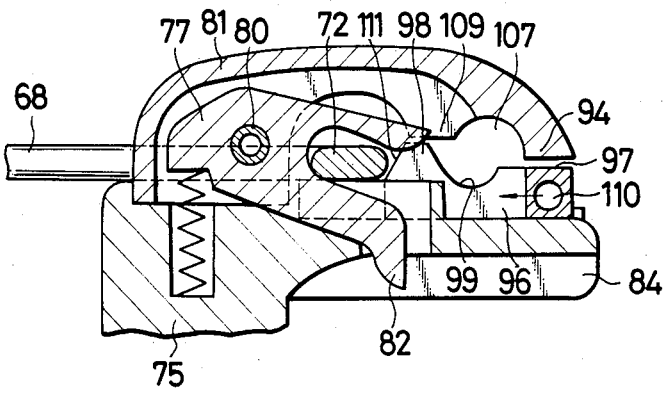
FIGS. 14A and 14B are longitudinal cross-sectional views of the slider shown in locked position.
Figure 14B:
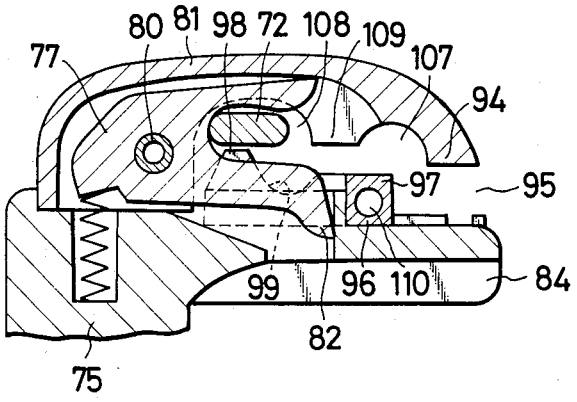

Then the lock ring 68 is turned about itself through an angle of 180 degrees until the second circumferential portion 72 is received in the recess 90 in the lock member 77 as shown in FIG. 14A. Due to its enlarged width, the circumferential portion 72 is prevented from sliding down the closure projections 98 as seen from FIG. 14B. Thus the slider 75 is firmly locked on the lock ring 68 even when the closure member 96 is moved to its open position.

To unlock the slider 75, the lock ring 68 is turned about itself through an angle of 180 degrees until the first circumferential portion 71 of the lock ring 68 is disposed in the recess 90 in the lock member 77. Then the lock ring 68 is removed from the slider 75 in the same menner as the pull tab detachment described above.

According to the last-mentioned embodiment, the slider 75 is locked against movement by the locking member 77 on one hand and by the lock ring 68 on the other hand.

Obviously, various modifications and variations of present invention are possible in the light of the above teaching. It is therefore to be understood that within the scope of the appended claims the invention may be practiced otherwise than as specifically described.

What is claimed is:

1. A lock device for releasably holding a slider in a fixed fastener full-closing position of a slide fastener attached to a container for closing an opening therein, said lock device comprising:

(a) a slider body including upper and lower wings joined at their front ends by a neck so as to define therebetween a guide channel for the passage of a pair of rows of coupling elements of the slide fastener;

(b) an arch-shaped lug extending over a top surface of said upper wing and having one end connected to the front end of said upper wing and an opposite end directed toward said top surface and spaced therefrom by a gap;

(c) a closure member slidably mounted in said upper wing and movable in a direction parallel to a longitudinal axis of said slider body between a closed position to substantially close said gap and an open position to open said gap, said closure member being normally urged to said closed position;

(d) a lock ring adapted to be connected to a portion of the container adjacent to the fixed fastener full-closing position, said lock ring being receivable through said gap into a space defined between said upper wing and said arch-shaped lug for locking said slider body in the fixed fastener full-closing position; and (e) a manually operative pin engageable with said closure member to urge the same to said open position to thereby allow said lock ring to be threaded through said gap into and out of said space.

2. A lock device according to claim 1, said slider body further including a lock member pivotally disposed in said space and movable into and out of said guide channel for releasably locking said slider body in position on the coupling element rows, said lock member having a recess receptive of a circumferential portion of said lock ring.

3. A lock device according to claim 2, further including a pull tab threaded onto said arch-shaped lug for pivotal movement relative to said slider body and having a pintle receivable in said recess in said lock member for moving said lock member out of said guide channel, said pintle having a diameter smaller than said gap.

4. A lock device according to claim 1, further including a pull tab pivotably connected to said lug, said pin being disposed in said pull tab.

5. A lock device according to claim 4, said pull tab including a body and a hook-shaped shackle pivotably and rotatably connected to said body and movable between a closed position in which a free end of said shackle is received in said body and an open position in which said free end is separated from said body, said shackle being normally urged to said open position, said pull tab further including a latch bolt slidably received in said body and normally urged into locking engagement with said base portion.

6. A lock device according to claim 5, said pull tab body having a first hole extending in a first direction and receiving said base portion and a second hole extending perpendicular to said first hole and receiving said latch bolt, said pin being connected with said latch bolt and projectable from said body when said latch bolt is released from said base portion.

7. A lock device according to claim 5, said base portion having a plurality of barb-like members engageable with said latch bolt.

8. A lock device according to claim 1, said lock ring being rotable about itself and having a first circumferential portion capable of threading through said gap and a second circumferential portion incapable of threading through said gap.

9. A lock device according to claim 8, said first and second circumferential portions being disposed in diametrically opposite relation to one another.

10. A lock device according to claim 8, said first circumferential portion having a circular cross-sectional shape of a diameter smaller than said gap, said second circumferential portion having an oblong cross-sectional shape having a width larger than said gap.

* * * * *